US005214237A

United States Patent [19]

McArthur

[11] Patent Number: 5,214,237

[45] Date of Patent: May 25, 1993

[54] FLUOROCARBON RESIN BULLET AND METHOD OF MAKING SAME

[75] Inventor: Bruce D. McArthur, 8735 Dixie Hwy., Clarkston, Mich. 48016

[73] Assignees: Bruce D. McArthur; Carolyn M. McArthur, both of Clarkston, Mich.

[21] Appl. No.: 847,862

[22] Filed: Feb. 28, 1992

Related U.S. Application Data

[63] Continuation of Ser. No. 550,337, Jul. 9, 1990, abandoned.

[51] Int. Cl.[5] ..... F42B 8/14; F42B 12/34; F42B 12/00

[52] U.S. Cl. ..... 102/501; 102/506; 102/509; 102/529

[58] Field of Search ..... 102/501, 502, 507-511, 102/529, 532, 506

[56] References Cited

U.S. PATENT DOCUMENTS

| | | | |
|---|---|---|---|
| 3,326,133 | 6/1967 | Stadler et al. | 102/529 |
| 3,580,178 | 5/1971 | Kopsch et al. . | |
| 3,802,345 | 4/1974 | La Costa | 102/522 |
| 3,861,311 | 1/1975 | Bilsbury . | |
| 3,902,683 | 9/1975 | Bilsbury . | |
| 3,972,286 | 8/1976 | Canon | 102/507 |
| 4,005,660 | 2/1977 | Pichard | 102/501 |
| 4,008,667 | 2/1977 | Look . | |
| 4,063,511 | 12/1977 | Bullard | 102/501 |
| 4,193,348 | 3/1980 | Halverson | 102/509 |
| 4,245,557 | 1/1981 | Knappworst et al. | 102/510 |
| 4,251,079 | 2/1981 | Earl et al. | 102/501 |
| 4,290,365 | 9/1981 | Dreyer | 102/532 |
| 4,708,065 | 11/1987 | Schilling et al. | 102/501 |

FOREIGN PATENT DOCUMENTS

| | | |
|---|---|---|
| 784985 | 5/1968 | Canada . |
| 1092349 | 11/1960 | Fed. Rep. of Germany . |
| 2551196 | 2/1976 | France . |
| 2431676 | 7/1978 | France . |

OTHER PUBLICATIONS

S. Tyles in Small Arms Projectiles, by Green, Army Ordnance, May-Jun. 1932, pp. 395-401.

*Primary Examiner*—Harold J. Tudor
*Attorney, Agent, or Firm*—Streich Lang

[57] ABSTRACT

A bullet is provided which is substantially 100% pure fluorocarbon resin. In the preferred embodiment a fluorocarbon resin in the form of polytetrafluoroethylene, preferably Teflon from E.I. Dupont De Nemours Co., Inc. of New Jersey, also known as Dupont, is provided with multiple annular grooves near the rear end and a hollow point front end. The bullet in the preferred embodiment is characterized by having a high muzzle velocity, a very short effective range, and pulverizes on impact so as to deliver considerable hydrostatic shocking effect by delivery of all of its energy within the first two to three inches of target depth.

4 Claims, 1 Drawing Sheet

FLUOROCARBON RESIN BULLET AND METHOD OF MAKING SAME

This is a continuation of application Ser. No. 07/550,337 filed Jul. 9, 1990, abandoned.

SUMMARY OF THE INVENTION

A bullet is provided which is formed of a substantially cylindrical core material which is substantially a pure fluorocarbon resin that in the preferred embodiment is polytetrafluoroethylene manufactured by E.I. Dupont De Nemours Co., Inc. of New Jersey, also known as Dupont, under the trademark Teflon.

Several annular grooves are cut in the rear half of the bullet, which is characterized by having extremely high muzzle exit velocity. The grooves provide air resistance so as to limit the effective range of the bullet.

A hollow point is provided in the bullet in the preferred embodiment so as to cause the bullet to pulverize on impact and create considerable hydrostatic shock effect in the target by delivery of substantially all of the bullet energy within the first two to three inches of depth in the target, which generates a considerable shock wave in the target.

BACKGROUND OF THE INVENTION

Law enforcement personnel have considerable need for an effective bullet which can deliver a tremendous hydrostatic shock effect to its target while having limited range.

When deadly force is used within close range, a law enforcement officer must be able to immediately stop a criminal. Some criminals, particularly those who have been stimulated by mind altering drugs, continue to function in an erratic manner when hit with conventional bullets. Several conventional metal bullets having high penetration characteristics may pass through the body of such a criminal without bringing the criminal to a stop because such bullets do not provide sufficient hydrostatic shock effect to such a target.

Law enforcement officials in close quarters also have a need for a bullet which flies true at short range but which has a limited range so as to minimize the danger to innocent persons outside the useful range of the bullet.

Bullet inventors generally have attempted to maximize penetration capability of their bullets. Bullets conventionally are made to fly true by providing rifling in the barrel of a rifle or other weapon by using several grooves down the barrel of the weapon to impart rotation spin to the bullet around its axis.

Bullets customarily are made of a metal and may be coated with non-metal materials to reduce friction when traveling down the rifling of a weapon barrel and to increase target penetration. Kopsch U.S. Pat. No. 3,580,178 is a patent which teaches the use of a fluorocarbon resin such as polytetrafluoroethylene, which is most commonly manufactured by E.I. Dupont De Nemours Co., Inc. of New Jersey, also known as Dupont, under the trademark Teflon, as a low friction coating on a bullet to reduce friction in the firing weapon and increase penetration in the target.

Non-metal bullets have been occasionally invented and used. Stadler et al 784,985 is a Canadian Patent which teaches use of plastic bullets to make target ammunition which is cheaper than metal bullets and which easily breaks upon impact with the target so as to minimize ricochet. Stadler et al utilizes a blunt bullet end to increase air resistance and reduce effective range of the bullet.

Bilsbury U.S. Pat. No. 3,902,683 is a patent which further teaches use of plastic bullets for target practice to reduce ricochet.

Bilsbury U.S. Pat. No. 3,861,311 teaches a combination of a plastic bullet with an incendiary material so as to create an armor piercing bullet which utilizes a plastic jacket which ruptures on impact and lets a metal penetrator pierce the target with the assistance of the incendiary material.

Look U.S. Pat. No. 4,008,667 is a patent which teaches use of aerodynamic brakes in the bullet to minimize flight distances.

Flight distances can also be reduced by providing a bullet with annular grooves, such as taught in French Patent 2,551,196 and German Patent 1 092 349 and French Patent 2,431,676.

However, none of these Patents teach the use of a bullet which is manufactured of a pure fluorocarbon resin for any purpose. The high melting point of a fluorocarbon resin, particularly the polytetrafluoroethylene used in the preferred embodiment which is commonly manufactured by Dupont under the trademark Teflon, requires such high temperatures for molding that a conventional mold has short lifetime.

None of the various prior art patents specifically address or solve the problem of such targets as a drug crazed dangerous human having to be stopped immediately at short distances, which would require a bullet having minimal penetration and maximum hydrostatic shock effect.

It is therefore a primary object of this invention to provide a bullet which is characterized by:

A. Tremendous hydrostatic shock effect in a target.

B. Tremendous muzzle velocity upon exiting a weapon.

C. Limited range.

D. Reasonable cost.

DESCRIPTION OF THE PREFERRED EMBODIMENT

Figure 1:
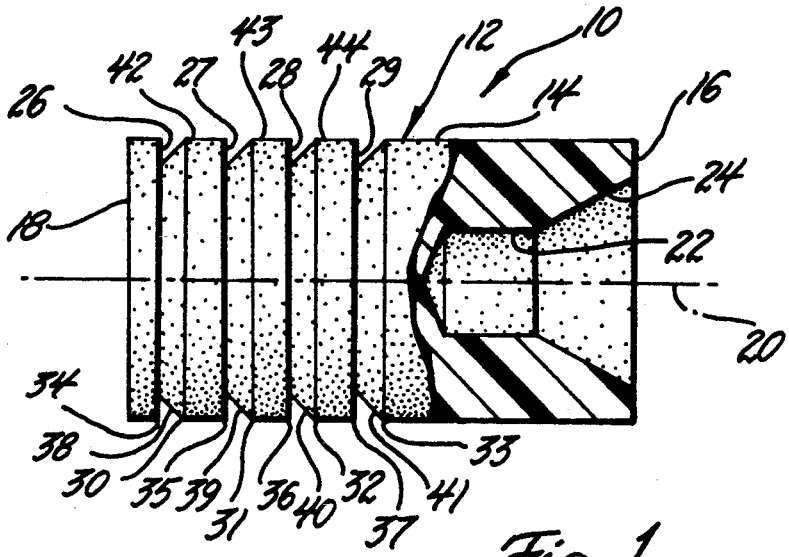
FIG. 1 is a side perspective front view with parts removed of a bullet embodying the principles of the subject invention in the preferred embodiment.
Figure 3:
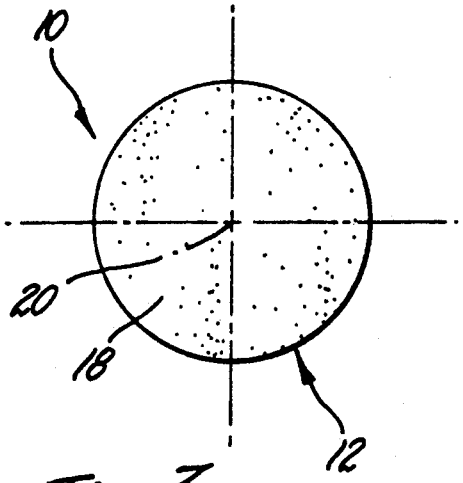
FIG. 3 is a perspective end view of the rear end of the bullet in FIG. 1.
Figure 2:
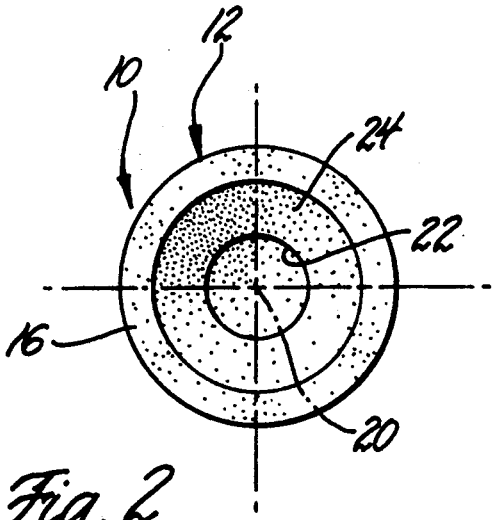
FIG. 2 is a perspective end view of the bullet in FIG. 1 showing the hollow point configuration.

A bullet 10 which embodies the principles of the subject invention is shown in FIG. 1. In the preferred embodiment bullet 10 is made of a core material 21 which the preferably comprises substantially a pure fluorocarbon resin, preferably polytetrafluoroethylene. This material is commonly manufactured by Dupont as stated under the trademark Teflon.

Bullet 10, as shown, has a substantially cylindrical body. More particularly, bullet 10 includes substantially cylindrical exterior surface 14, a front end 16, and a rear end 18. Bullet 10 is symmetrical about an axis 20 which defines the center of the bullet and the position of the cylindrical surface 14.

In FIG. 1 surface 14 of bullet 10 is partially removed to show that the central portion of the front end 16 preferably includes a cylindrical hole 22 drilled in front end 16 and a truncated conical interior surface 24. Surface 24 may be made by countersinking on hole 22 so as to provide a hollow point configuration in front end 16 for reasons which will become apparent.

In FIG. 1 bullet 10 is also provided with several annular grooves 26–29 which in the preferred embodiment each are positioned in planes which are substantially at right angles to axis 20. Grooves 26–29 have front edges 30–33 and rear edges 34–37. The respective front and rear edges of grooves 26–29 in the preferred embodiment are connected by truncated conical bottom groove surfaces 38–41, respectively.

In the preferred embodiment each line in each of the truncated conical bottom groove surfaces 38–41 which intersects the axis 20 does so at a about 60 degree angle.

Persons versed in the art will appreciate that bullet 10 may be manufactured in various sizes and configurations for various caliber weapons without departing from the spirit of the invention.

A typical 38 caliber metal bullet with a usual gun powder load propelling it has a muzzle exit velocity of 1,100 feet per second. Muzzle exit velocity will vary depending upon the size of the barrel in the weapon.

The Teflon bullet 10 in accordance with a preferred embodiment of the invention weighs less than a metal bullet and the inherent slippery nature of Teflon minimizes drag energy loss when traveling the rifling in the barrel of the weapon.

Bullet 10 in a 38 caliber size therefore has been tested to exit a four inch barrel with a muzzle velocity of approximately 2,800 feet per second. The muzzle exit velocity is in excess of 3,000 feet per second from a six inch barrel.

Kinetic energy is demonstrated by the formula that kinetic energy is equal to the mass of the object times the square of the velocity divided by two.

Therefore even though the mass of bullet 10 in accordance with the present invention is less than the mass of a similar metal bullet, bullet 10 has a greater kinetic energy than its counterpart metal bullet or metal bullet with Teflon coating such as that described in the Kopsch U.S. Pat No. 3,580,178.

The hollow point configuration of bullet 10 in front end 16 provides substantially instantaneous disintegration of bullet 10 upon impact with a target. Test firings into standard masses which approximate the construction of a human body have demonstrated that the bullet 10 on impact substantially disintegrates into particles approximately the size of ordinary table salt and have demonstrated that substantially all of the kinetic energy of bullet 10 is dissipated within the first two or three inches of impacting the target.

Bullet 10 at short range therefore has demonstrated a tremendous hydrostatic shock effect and creates a very high surface wound on impact and is designed to immediately stop an assailant, including persons functioning under the influence of mind altering drugs which would otherwise make them less susceptible to being stopped by bullets which merely penetrate a target.

The disintegration nature of the bullet 10 takes place upon impact with any object, including the target and background. Therefore if the target is missed, bullet 10 disintegrates upon striking the background without ricochet resulting to threaten bystanders.

Grooves 26 trough 29 have been developed so that in a typical bullet measuring approximately 0.69 inches in length the grooves measure 0.10 inches from the rear edge of one groove to the rear edge of the adjacent groove. Side sections 42–44 between grooves 26–29 in a bullet about 0.690 inches in length are each approximately 0.060 inches in length between grooves 26–29. Rear edges 34–37 of grooves 26–29 participate in producing aerodynamic drag on surface 14 so as to limit the range of bullet 10. Bullet 10 will fly true for a range of approximately 100 yards, but the aerodynamic drag slows bullet 10 to a speed where a person could catch it in their bare hand at a range of approximately 200 feet. Bullet 10 is therefore especially suitable for use in interior locations to minimize bystander risk. Persons versed in the art will appreciate that bystanders outside a building can be injured by weapons fired in the building which penetrate the building wall in a wood frame building.

At a range of 10 feet the hydrostatic shock effect of the bullet is so awesome that it will blast a four inch diameter hole four inches deep into a standard gelatin target designed to simulate a human body.

Teflon has such a high melting temperature that it is impractical to manufacture a bullet through a molding process. Efforts to do so resulted in a conventional mold being worn out after making only approximately 400 bullets.

The preferred manufacturing steps for manufacture of bullet 10 therefore include the steps of forming a core material 12 from a fluorocarbon resin cylinder, boring a hole in the front end 16 so as to form a hollow point, countersinking the hole, and cutting annular grooves in the cylinder side surface 14 so that each of the annular grooves 26–29 are substantially defined by a plane at right angles to axis 20.

Bullet 10 may be modified without departing from the spirit of this invention for purposes of achieving a bullet 10 having different flight and impact characteristics. Such modifications include but are not limited to the following suggestions.

If front end 16 is provided with the truncated conical surface 24 but does not have the cylindrical hole 22 extending deeper than surface 24, the bullet likely will not disintegrate upon impact but instead will penetrate farther and may even penetrate body armor. In accordance with the preferred embodiment of the invention, hole 22 is drilled deeper than interior surface 24 to prevent penetration of bullet 10 into objects, such as body armor.

If truncated conical interior surface 24 has a smaller diameter but the same depth, bullet 10 may not disintegrate upon impact and can penetrate body armor. In the preferred embodiment if the outside diameter of side surface 14 is 0.357 inches, a standard number 4 counterdrill is used up to its shoulder to create interior surface 24 at the appropriate diameter so as to prevent body armor penetration.

Annular grooves 26–29 are provided to maintain stability in flight by providing an exterior aerodynamic drag which keeps bullet 10 pointed forward rather than letting it tumble. Changing the groove width, depth, spacing or configuration may cause bullet 10 to be unstable in flight, resulting in tumbling and possible breakup during flight. If grooves 26–29 are too shallow bullet 10 becomes rigid and won't fully disintegrate upon impact and may ricochet. In the preferred embodiment for a 0.357 inch diameter side surface 14 the minimum diameter at the deepest part of grooves 26–29 is 0.307 inches.

The desirable flight characteristics of a Teflon bullet are believed to be unique to Teflon. Tests have shown that other common non-metallic materials are not appropriate for bullet 10 nor will they give the desired operating characteristics as described above.

By way of example, if bullet 10 is made of a rigid material such as nylon it becomes an armor piercing device. If it is made of various plastic materials, the structural integrity of bullet 10 is so weak that it disintegrates in flight.

Teflon provides the unique capacity for bullet 10 to function as described herein because it permits tremendous muzzle velocity due to its light weight and minimal friction in the firing weapon so as to provide tremendous hydrostatic shock effect at close range while preventing ricochet and long range hazard to bystanders.

I claim:

1. A bullet consisting of:

a polytetrafluoroethylene resin body disposed about a central axis, said body having a front end, a rear end, and a generally cylindrical exterior surface extending therebetween, said rear end of said body being solid and having a planar rear face;

a plurality of annular grooves in said exterior surface to facilitate disintegration of the bullet upon impact with a target, said grooves being positioned only proximate said rear end in a plurality of planes, each of said planes being substantially orthogonal to said axis;

a generally cylindrical axial blind bore disposed within said front end of said body, wherein said blind bore has a substantially uniform diameter along the length thereof; and said blind bore terminating at a truncated conical surface which extends from a front edge of said bore to an outermost portion of said front end of said body, wherein the diameter of said conical surface at said front end is larger than said uniform diameter of said axial bore.

2. The bullet according to claim 1, wherein each of said grooves includes a front edge, a rear edge and a substantially frusto-conical surface extending therebetween, said frusto-conical surface having a front end mating with said groove front edge and a rear end mating with said groove rear edge.

3. The bullet according to claim 2, wherein the diameter of each of said grooves at said rear end of said frusto-conical surface is less than the diameter of said groove at said groove front edge.

4. The bullet according to claim 2, wherein said frusto-conical surface is disposed at about a 60-degree angle from said central axis of the bullet.

* * * * *